US006804651B2

(12) United States Patent
Juric et al.

(10) Patent No.: US 6,804,651 B2
(45) Date of Patent: Oct. 12, 2004

(54) METHOD AND DEVICE FOR DETERMINING A MEASURE OF QUALITY OF AN AUDIO SIGNAL

(75) Inventors: Pero Juric, Solothurm (CH); Bendicht Thomet, Bern (CH)

(73) Assignee: Swissqual AG, Zuchwil (CH)

( * ) Notice: Subject to any disclaimer, the term of this patent is extended or adjusted under 35 U.S.C. 154(b) by 18 days.

(21) Appl. No.: 10/101,533

(22) Filed: Mar. 19, 2002

(65) Prior Publication Data

US 2002/0191798 A1 Dec. 19, 2002

(30) Foreign Application Priority Data

Mar. 20, 2001 (EP) ..... 01810285

(51) Int. Cl.[7] ..... G10L 13/02; G10L 13/04

(52) U.S. Cl. ..... 704/265; 704/200.1; 704/219; 704/229; 704/203; 381/94.3; 381/2; 381/120; 381/98

(58) Field of Search ..... 704/200.1, 219, 704/229, 230, 226–233, 211, 222, 203, 265; 381/2, 94.3, 120, 1, 11, 13, 98

(56) References Cited

U.S. PATENT DOCUMENTS

| | | | | | |
|---|---|---|---|---|---|
| 4,897,878 | A | * | 1/1990 | Boll et al. | 704/233 |
| 4,972,484 | A | * | 11/1990 | Theile et al. | 704/200.1 |
| 5,577,161 | A | * | 11/1996 | Pelaez Ferrigno | 704/226 |
| 5,583,968 | A | * | 12/1996 | Trompf | 704/232 |
| 5,596,364 | A | * | 1/1997 | Wolf et al. | 348/192 |
| 6,122,610 | A | * | 9/2000 | Isabelle | 704/226 |
| 2002/0054685 | A1 | * | 5/2002 | Avendano et al. | 381/66 |
| 2003/0101048 | A1 | * | 5/2003 | Liu | 704/208 |

FOREIGN PATENT DOCUMENTS

| | | | | |
|---|---|---|---|---|
| EP | 0 644 526 A1 | * | 8/1994 | G10L/3/02 |
| WO | WO 00/72453 A1 | * | 11/2000 | H04B/1/00 |

OTHER PUBLICATIONS

Dobson et al., ("High quality low complexity scalable wavelet audio coding", 1997 IEEE International Conference on Acoustics, speech, and signal Processing, 1997, ICASSP–97, vol. 1, pp. 327–330).*

Purat et al., ("Audio coding with a dynamic wavelet packet decomposition based on frequency–varying modulated lapped transforms", 1996 IEEE Conference on Acoustics, Speech, and Signal Processing, 1996,.iCASSP–96, vol. 2, pp. 1021–1024).*

Chong et al., ("A new waveform Interpolation coding scheme based on pitch synchronous wavelet transform decomposition", IEEE Transactions on Speech and Audio Processing, vol. 8, issue 3, pp. 345–348).*

(List continued on next page.)

*Primary Examiner*—Vijay Chawan
(74) *Attorney, Agent, or Firm*—Pillsbury Winthrop LLP

(57) ABSTRACT

Initially, voice signal components (4) are extracted from the audio signal (1) in a procedure for determining a measure of quality (2) of an audio signal (1). Based on this signal, a reference signal (6) is then generated by means of noise suppression (7) and interruption interpolation (8). This signal is compared with the voice signal (4) and an intrusive quality value (10) is determined in this way. A further quality value (15) is determined by establishing and evaluating (12, 14) codec-related signal distortions in the voice signal (4). Another quality value (17) is generated from the information relating to the detected signal interruptions (8). The measure of quality (2) is finally determined as a linear combination (16) of the various quality values (10, 15, 17, 18).

15 Claims, 5 Drawing Sheets

OTHER PUBLICATIONS

Figure 1:
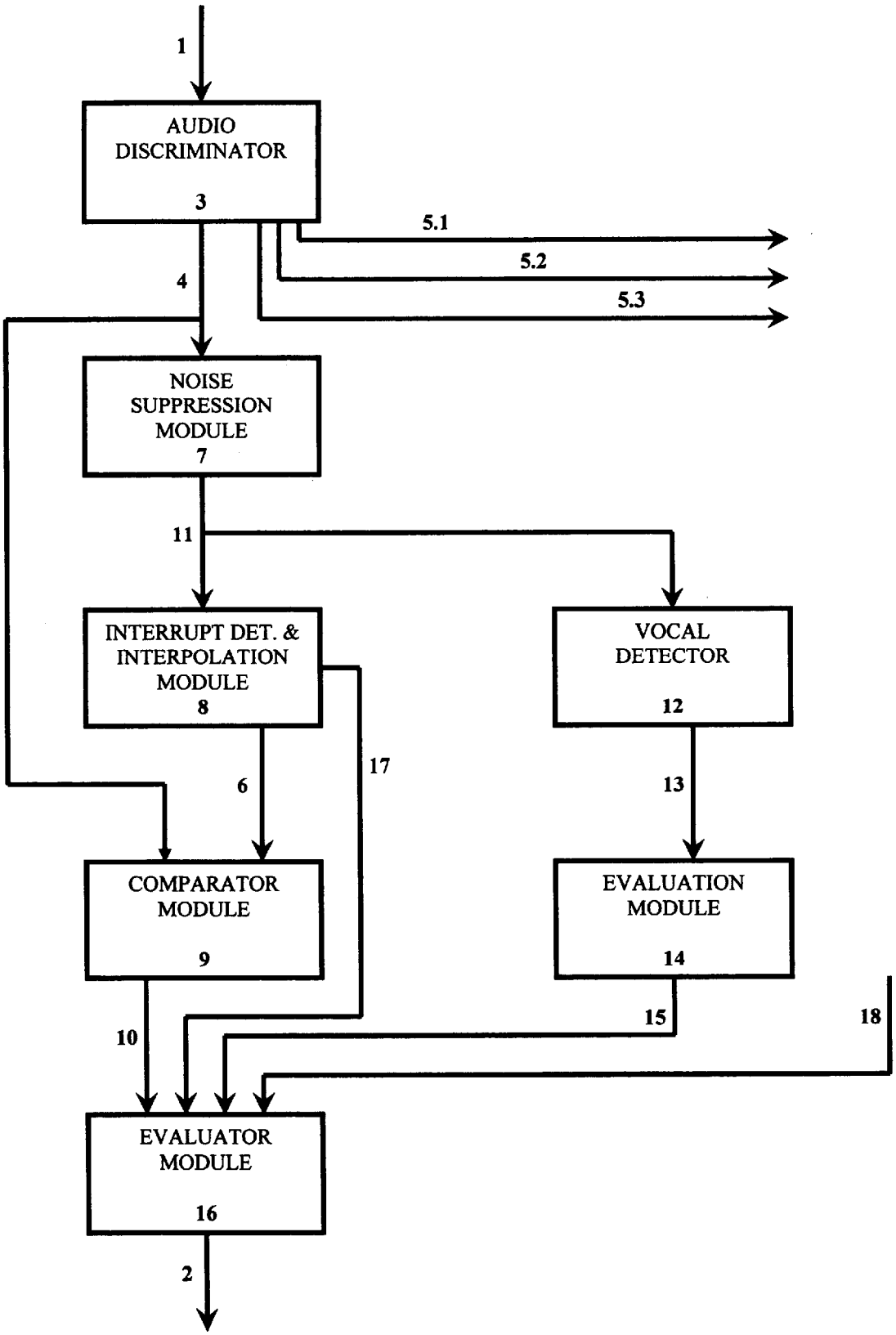

Hosoi et al., ("Audio coding using the best level wavelet packet transform and auditory masking", ICSP'98, pp. 1138–1141).*

Soek et al., ("Speech enhancement with reduction of noise components in the wavelet domain", 1997 IEEE International Conference on Acoustics, Speech, and signal Processing, 1997. ICASSP–97, vol. 2, pp. 1323–1326).*

Sinha et al., ("Synthesis/coding of audio signals using optimized wavelets", 1992 IEEE International Conference on Acoustics, Speech, and Signal Processing, 1992. ICASSP–92, vol. 1, pp. 113–116).*

Srinivasan et al., ("High–Quality audio compression using an adaptive wavelet packet decomposition and psychoacoustic modeling", IEEE transactions on Signal Processing, vol. 46, Issue 4, Apr. 1998, pp. 1085–1093).*

Ning et al., ("A new audio coder using a warped linear prediction model and the wavelet transform", 2002 IEEE international Conference on Acoustics, Speech, and Signal Processing, vol. 2, pp. 1825–1828).*

Hamdy et al., ("Time–scale modification of audio signals with combined harmonic wavelet representations", 1997 IEEE International Conference on Acoustics, Speech, and Signal Processing, 1997. ICASSP–97, vol. 1, pp. 439–442).*

Wunnava et al.,("multilevel data compression techniques for transmission of audio over networks", Proceedings IEEE 2001 SoutheasCon 2001, pp. 234–238).*

* cited by examiner

METHOD AND DEVICE FOR DETERMINING A MEASURE OF QUALITY OF AN AUDIO SIGNAL

TECHNICAL ASPECTS

The invention relates to a procedure for determining a measure of quality of an audio signal. Furthermore, the invention refers to a device for implementing this procedure as well as a noise suppression module and an interrupt detection and interpolation module for use in such a device.

STATE OF THE ART

Assessing the quality of a telecommunications network is an important instrument for achieving and maintaining the required service quality. One method of assessing the service quality of a telecommunications network involves determining the quality of a signal transmitted via the telecommunications network. In the case of audio signals and in particular voice signals, various intrusive procedures are known for this purpose. As the name suggests, such procedures intervene in the system to be tested in such a way that a transmission channel is allocated and a reference signal is transmitted along it. The quality is then assessed subjectively, for example, by one or several test persons comparing the known reference signal with the received signal. This procedure is, however, elaborate and therefore expensive.

A further intrusive procedure for machine-assisted quality assessment of an audio signal is described in EP 0 980 064 where a spectral similarity value of the known source signal and the received signal are determined for the purpose of assessing the transmission quality. This similarity value is based on a calculation of the covariance of the spectra of the source signal and of the receive signal and division of the covariance by the standard deviations of both specified spectra.

Intrusive methods, however, generally have the disadvantage that, as already mentioned, it is necessary to intervene in the system to be tested. This means, to determine the signal quality, at least one transmission channel must be occupied and a reference signal transmitted on it. This transmission channel cannot be used for data transfer purposes during this period of time. In addition, although in a broadcasting system such as a radio service for example it is in principle possible to assign the signal source for transmitting test signals, however, since all channels are consequently occupied and the test signal would be transmitted to all receivers, this procedure is extremely impractical. Intrusive procedures are likewise unsuitable for the purpose of simultaneously monitoring the quality of a large number of transmission channels.

DESCRIPTION OF THE INVENTION

The task of the invention is to provide a procedure of the above-specified type that avoids the disadvantages of the state of the art and, in particular, provides an opportunity for assessing the signal quality of a signal transmitted via a telecommunications network without knowledge of the originally transmitted signal.

The solution to this task is defined by the features of Patent Claim 1. Initially, in the inventive procedure for machine-assisted definition of a measure of quality of an audio signal a reference signal is determined from the audio signal. By comparing the determined reference signal with the audio signal, a quality value is defined that is then used for determining the measure of quality.

The inventive procedure therefore permits assessment of the quality of an audio signal at any connection of the telecommunications network. This means it therefore also permits quality assessment of many transmission channels simultaneously so that even simultaneous assessment of all channels would be possible. Here, the quality is assessed on the basis of the properties of the received signal, i.e. without knowledge of the source signal or of the signal source.

The invention therefore not only enables monitoring of the transmission quality of the telecommunications network but also, for example, quality-based billing/accounting, quality-based routing in the network, coverage testing in mobile radio networks, quality of service (QOS) control of network nodes or quality comparison within a network as well as globally throughout the network.

In addition to the required signal information, an audio signal transmitted via a telecommunications network characteristically also exhibits undesirable components such as various noise components that did not exist in the original source signal.

The best possible estimate of the originally transmitted signal is necessary in order to be able to assess the quality most effectively. Various methods can be used for the purpose of reconstructing this reference signal. One option involves estimating the characteristics of the transmission channel and calculating backwards starting from the received signal. A further option entails a direct estimate of the reference signal based on the known information relating to the received signal and the transmission channel.

In this particular method, the reference signal is determined by estimating the interference signal components contained in the received signal and then removing them from the received signal. By removing the noise components from the audio signal, initially, a de-noised audio signal is determined that is preferably used as the reference signal for assessing the transmission quality.

There are various methods of removing noise components from the received audio signal. For example, the audio signal could be routed via corresponding filters. In a preferred method for removing the noise components from the audio signal, a neuronal network is used for this purpose.

The audio signal, however, is not used directly as the input signal. Initially, the audio signal is subject to discrete wavelet transformation (DWT). This transformation produces a number of DWT coefficients of the audio signal that are fed to the neuronal network as the input signal. The neuronal network makes available a number of corrected DWT coefficients at its output, from which the reference signal is derived with inverse DWT. This signal corresponds to the de-noised (noise-free) version of the audio signal.

In order to achieve this, the coefficients of the neuronal network must be set in such a way that it produces the DWT coefficients of the corresponding de-noised input signal in response to the DWT coefficients of a noise-laden input signal. To ensure the neuronal network supplies the required coefficients, it must first be taught with a set of corresponding noise-laden and de-noised signal pairs.

In this way, both stationary noise such as white, thermal, vehicle or road noise as well as pulse noise can be suppressed. Also echoes and interference can be suppressed or eliminated with the neuronal network.

In addition to the quality value that is determined by comparing the received audio signal with the established reference signal, any other information can be taken into consideration when determining the measure of quality. This may be both information contained in the audio signal as well as information relating to the transmission channel or the telecommunications network itself.

When determining the measure of quality, it is of advantage to use information that can be derived from the received audio signal itself using suitable means. For instance, the quality of the received audio is influenced by the codecs (coder-decoders) through which the signal passes during transmission. It is difficult to determine such signal degradation as a part of the original signal information is lost if the codec bit rates are too low. On the other hand, low codec bit rates result in a change in the fundamental frequency (pitch) of the audio signal which is why the progression and the dynamics of the fundamental frequency are examined advantageously in the audio signal. Since such changes can be examined easiest on the basis of audio signal sections with vocals, initially, signal components with vocals are detected in the audio signal and then examined for pitch variations.

Let us return to determining the reference signal from the received audio signal. This signal can exhibit not only undesirable signal components but also required information may be lost when under way. Consequently, the received audio signal may exhibit signal interruptions to a greater or lesser extent.

However, the closer the reference signal generated from the audio signal is to the original source signal, the more precise the assessment of the transmission quality. This is the reason for replacing signal interruptions by suitable signals. Suitable noise signals as well as signal sections already transmitted may be used for this purpose.

In order to obtain the most accurate estimate of the reference signal as possible, however, it is of advantage to initially detect such signal interruptions in the audio signal and then to replace the missing signal sections by estimates achieved as accurately as possible by interpolation. In this case, the type of interpolation of the lost signal sections depends on the length of the signal interruption. In the case of short interruptions, i.e. interruptions up to a few sampling values in the audio signal, polynomial interpolation is preferably used and in the case of medium-long interruptions, i.e. from a few to several dozen scanning values, model-based interpolation is preferably used.

Longer signal interruptions, however, i.e. interruptions from several dozen scanning values can be scarcely reconstructed feasibly. Instead of considering this information as superfluous and to dismiss it, this information and, in part, also information relating to the short and medium signal interruptions is taken into consideration in the assessment of the transmission quality. It is used in the calculations for determining the measure of quality.

The received audio signal can comprise various types of audio signals. For instance, it can contain voice, music, noise as well as rest (off state) signal components. The quality can, of course, also be assessed on the basis of all or part of these signal components. In a preferred variant of the invention, however, assessment of the signal quality is confined to the voice signal components. Consequently, the voice signal components are initially extracted from the audio signal using an audio discriminator and only these voice signal components are then used for determining the measure of quality, i.e. for establishing the reference signal. To determine the quality in this case, the determined reference signal is, of course, not compared with the received audio signal but rather only with the voice signal component extracted from it.

The invention-compliant device for machine-assisted determination of a measure of quality of an audio signal comprises first means for determining a reference signal from the audio signal, second means for determining a quality value by comparing the determined reference signal with the audio signal as well as third means for determining the measure of quality while taking the quality value into consideration.

The first means for determining a reference signal from the audio signal can comprise several modules. Therefore, a noise suppression module and/or an interruption detection and interpolation module should preferably be provided.

The noise suppression module is used to suppress noise signal components in the received audio signal. It contains the means for implementing the wavelet transformations as already described as well as the neuronal network for determining the new DWT coefficients. The interruption detection and interpolation module features such means that are required, on the one hand, for detecting signal interruptions in the audio signal and, on the other hand, for polynomial interpolation of short signal interruptions as well as for model-based interpolation of medium-long signal interruptions. The reference signal determined in this way therefore corresponds to a de-noised version of the received audio signal and characteristically exhibits only larger signal interruptions.

The information relating to the signal interruptions of the audio signal, however, is not only used for establishing a better reference signal but it can also be used for determining a better measure of quality. The third means for determining the measure of quality are therefore preferably designed in such a way that information relating to signal interruptions in the audio signal can be taken into consideration.

The more information on the audio signal that is used in determining the measure of quality, the more accurate the quality assessment. The device therefore advantageously features the fourth means for determining information on codec-related signal distortions. These means comprise, for example, a vocal detection module that can be used to detect signal components with vocals in the audio signal. These vocal signal components are routed to an evaluation module which, based on these signal components, determines information on codec-related signal distortions that are also used for the purpose of determining the signal quality. The third means are correspondingly designed in such a way that this information on the codec-related signal distortions can be taken into consideration in determining the measure of quality.

Advantageously however, not the entire audio signal is used for assessing the quality but rather only its voice signal components. Corresponding to the procedure already described, the device therefore features in particular the fifth means for extracting the voice signal components from the audio signal. Correspondingly, the audio signal itself is not used for determining the reference signal but rather only its voice signal component is de-noised and examined with regard to interruptions. Likewise, the audio signal is, of course, not compared with the reference signal but rather only its voice signal component. Consequently, the measure of quality is determined only on the basis of the information in the voice signal component while the information from the remaining system components is not taken into consideration.

Further advantageous variants and feature combinations of the invention arise from the following detailed description and the patent claims in their entirety.

SHORT DESCRIPTION OF THE DRAWINGS

The drawings used to explain the version example show:

FIG. 1 A schematic block diagram of the inventive procedure

Figure 2:
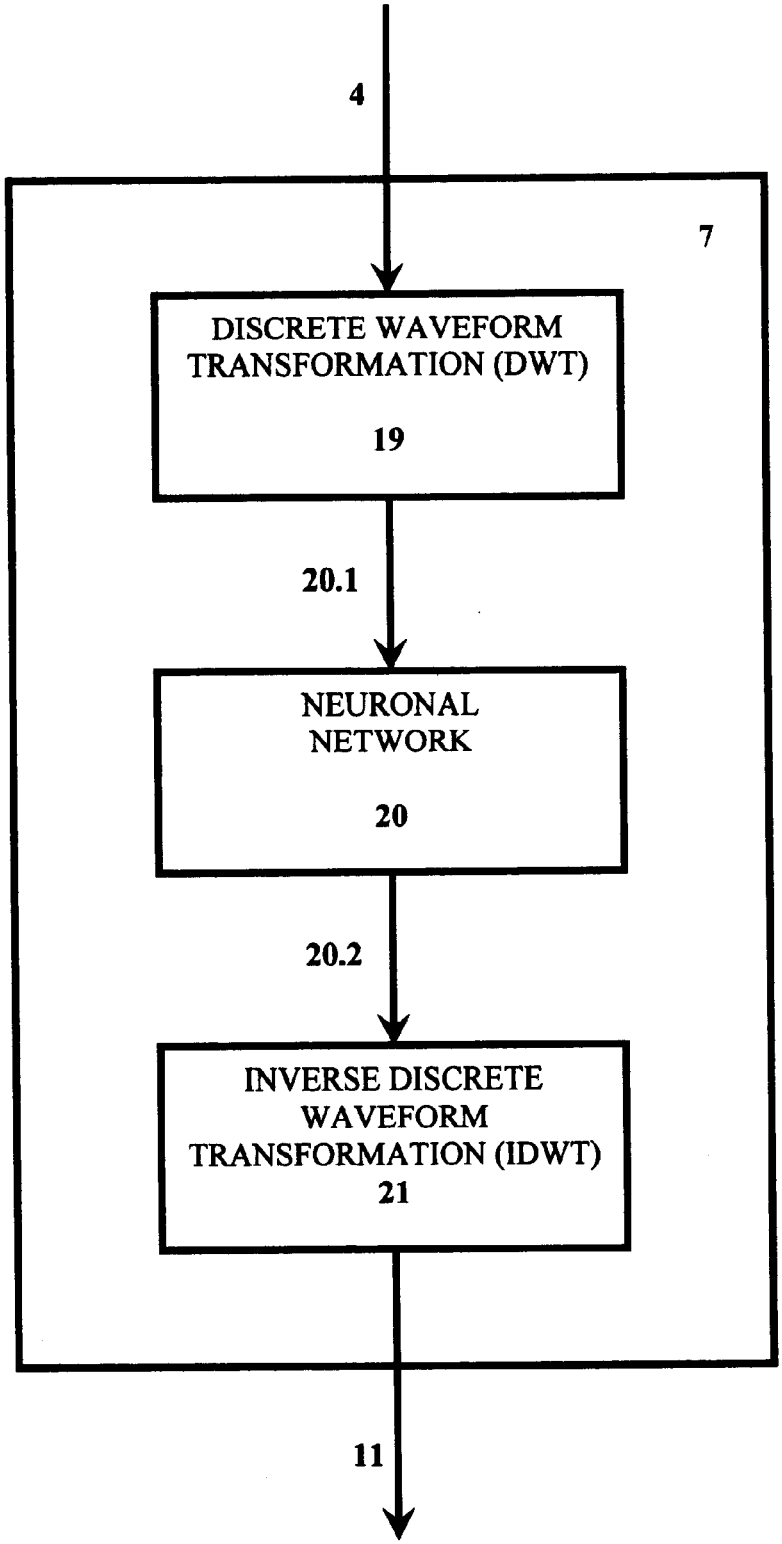

FIG. 2 The noise suppression module in operating mode

Figure 3:
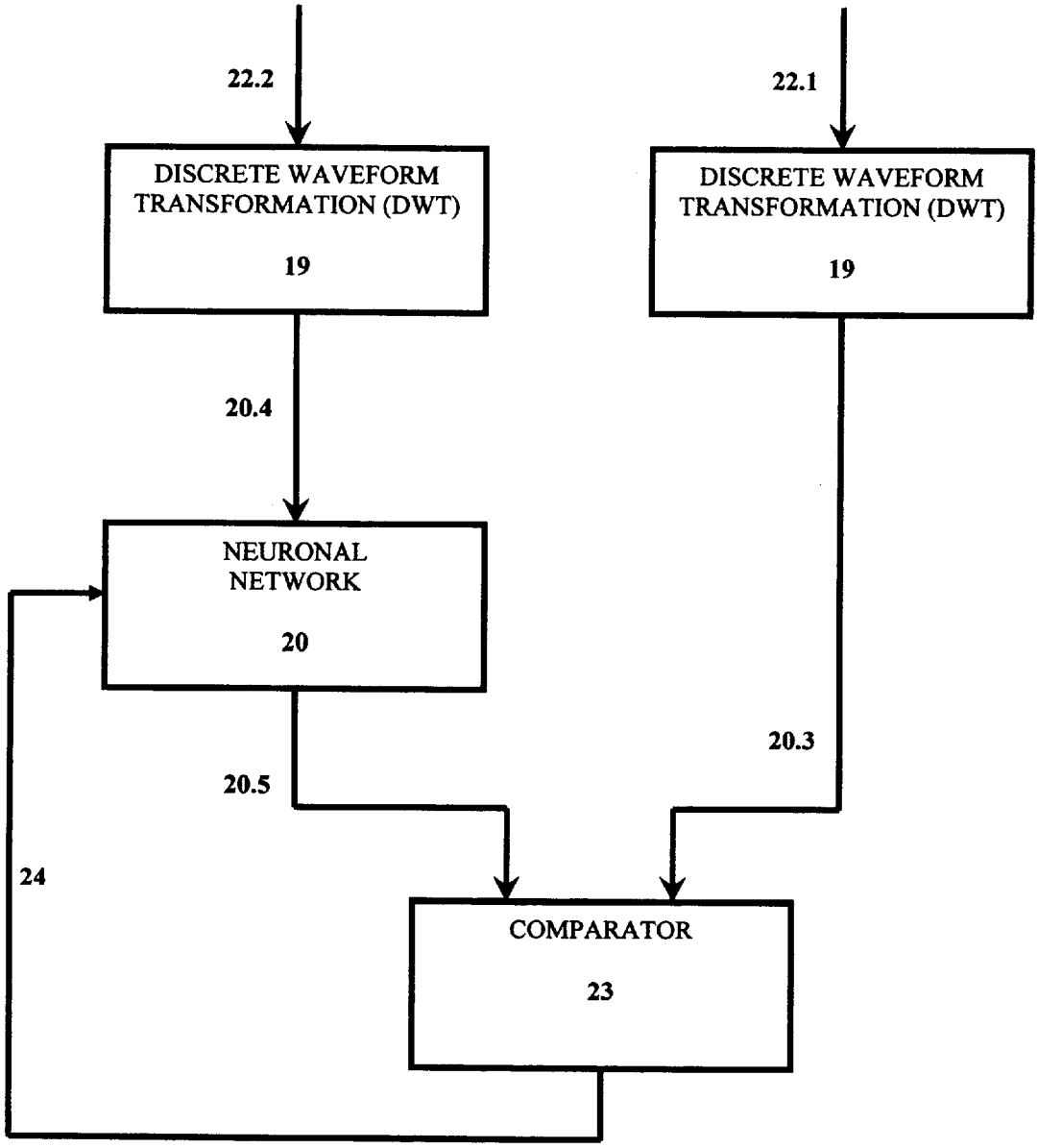

FIG. 3 The noise suppression module in teach-in mode

Figure 4:
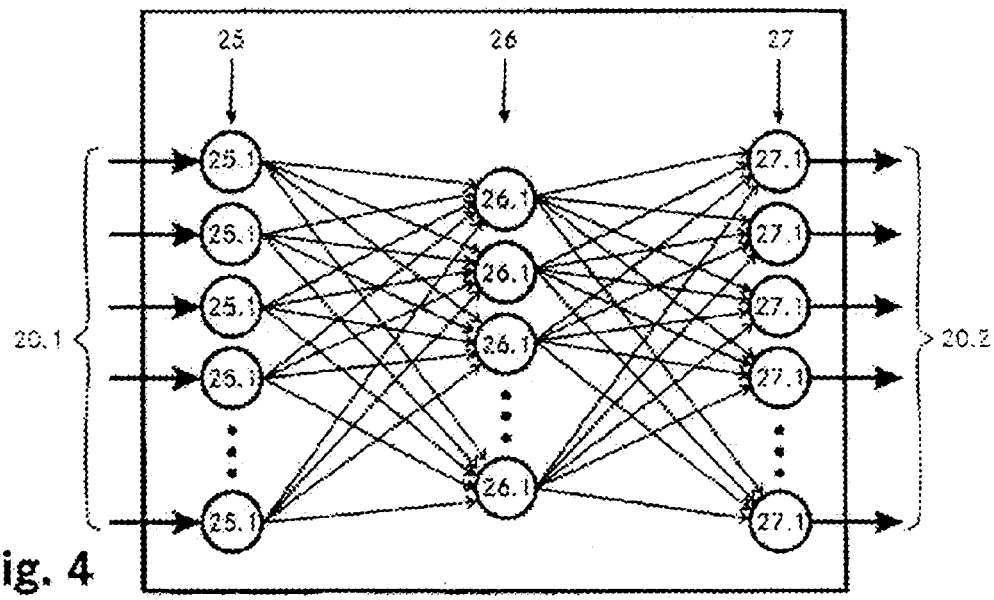

FIG. 4 The neuronal network of the noise suppression module and

Figure 5:
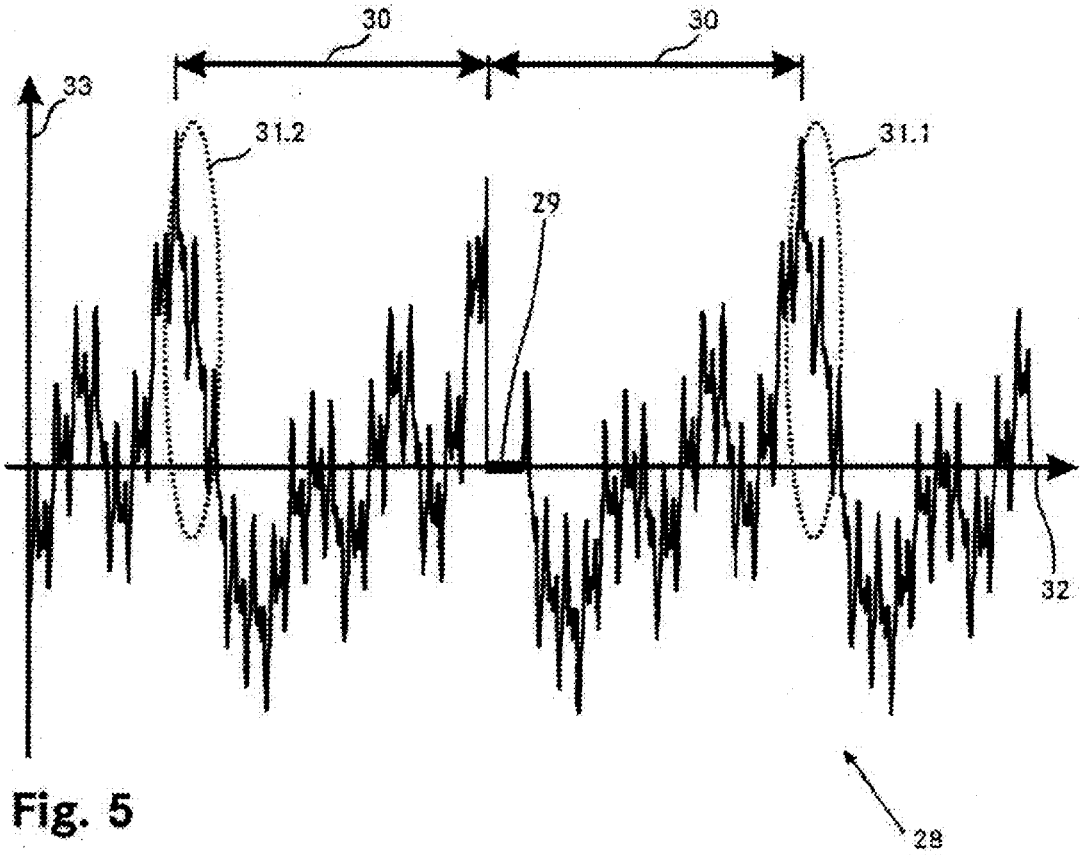

FIG. 5 An example of an audio signal with an interruption

The same parts in the figures always have the same reference numbers.

WAYS OF REALISING THE INVENTION

FIG. 1 shows a block diagram of the inventive procedure. A measure of quality 2 which, for example, can also be used for evaluating the used (not shown) telecommunications network, is determined for an audio signal 1. The term audio signal 1 refers to the signal received by a receiver following transmission via the telecommunications network. Characteristically, this audio signal 1 does not agree with the signal sent by the (not shown) receiver as, on the way from the transmitter to the receiver, the transmitted signal is changed in a great variety of different ways. For instance, the signal passes through various modules such as voice coders and decoders, multiplexers and demultiplexers or also voice improvers and echo compensators. But also the transmission channel itself can have a great influence on the signal in the form of interference, fading, transmission termination or interruption, echo generation etc.

The audio signal 1 therefore contains not only desirable signal components, i.e. the original transmitted signal, but also undesirable interference signal components. It is also possible for signal components of the transmitted signal to be absent, i.e. they are lost during transmission.

In the shown example, the signal quality is, however, not assessed on the basis of the entire audio signal but rather only on the basis of the voice component contained in the signal. Initially, the audio signal 1 is examined with an audio discriminator 3 for voice signal components 4. Found voice signal components 4 are passed on for further processing while other signal components such as music 5.1, pauses (breaks) 5.2 or strong signal interference 5.3 are sorted out and can be further processed otherwise or ejected. In order to be able to implement this differentiation, the audio signal 1 is transferred to the audio discriminator 3 in parts, i.e. in small segments each of approx. 100 ms to 500 ms. The audio discriminator further breaks down these segments into individual buffers of a length of approx. 20 ms, processes these buffers and then allocates them to one of the signal groups to be differentiated, i.e. voice signal, music, pause or strong interference.

To assess the signal segments, the audio discriminator 3 uses, for example, LPC (linear predictive coding) transformation, with which the coefficients of an adaptive filter corresponding to the human voice spectrum are calculated. These signal segments are allocated to the various signal groups based on the form of the transmission characteristics of this filter.

In order to be able to assess the quality of the transmission, a reference signal 6 is now derived from this voice signal component 4, i.e. the best possible estimate of the signal originally sent by the transmitter. This reference signal estimate involves a multi-stage process.

In the first stage, i.e. a noise suppression module 7, undesirable signal components such as static noise or pulse interference are initially removed or suppressed from the voice signal component 4. This takes place with the aid of a neuronal network which was taught beforehand by means of a large number of noise-laden signals as the input and the corresponding noise-free version of the input signal as the target signal. The de-noised voice signal 11 obtained in this way is then routed to the second stage.

In the second stage, the interrupt detection and interpolation module 8, interruptions in the audio signal 1 or in its voice signal component 4 are detected and interpolated if possible, i.e. the missing samples are replaced by suitably estimated values.

In this example, signal interruptions are detected by checking for discontinuities of the signal fundamental frequency (pitch tracing). Interpolation is carried out dependent on the length of the detected interruption. In the case of short interruptions, i.e. interruptions with a length of a few samples, polynomial interpolation is used such as, for example, Lagrange, Newton, Hermite or cubic spline interpolation. In the case of medium-long interruptions (few to several dozen samples), model-based interpolation is used such as, for example, maximum a posteriori, auto-aggressive or frequency-time interpolation. In the case of longer signal interruptions, interpolation or any other signal reconstruction is generally no longer possible in a feasible manner.

The entire procedure is made more difficult by the fact that there are both different types of interruptions—a differentiation must be made between syllable and word breaks and proper signal interruptions—as well as different types of technical systems for processing such interruptions in the transmission channel. For instance, depending on the information relating to the transmission network, a terminal unit can respond differently to absent frames. In a first method, lost frames are simply replaced by zeroes. In a second method, instead of the lost frames, other, correctly received frames are used and in a third method, instead of the lost frames, locally generated noise signals, so-called "comfort noise" are used.

After determining the reference signal 6 with the noise suppression module 7 and the interruption detection and interpolation module 8, it is compared with the voice signal component 4 with the aid of the comparator module 9. An algorithm can be used for this comparison, as known, for example, from intrusive procedures for comparing the known source signal with the received signal. Particularly suitable for this purpose are, for example, psycho-acoustic models that compare the signals perceptively. The result of this comparison is an intrusive quality value 10. For the purpose of determining this intrusive quality value 10, the input signals, i.e. the voice signal component 4 and the reference signal 6, are broken down into signal segments of approx. 20 to 30 ms length and a part quality value is calculated for each signal segment. After approx. 20 to 30 signal segments, approximately corresponding to a signal duration of 0.5 seconds, the intrusive quality value 10 is determined as the arithmetic mean of these part quality values. The intrusive quality value 10 forms the output signal of the comparator module 9.

In addition to the information relating to interference signal components and/or signal interruptions, other information relating to the audio signal 1 can be taken into consideration when determining the measure of quality 2. For instance, a voice coder and voice decoder through which the transmitted signal passes on its way from the transmitter to the receiver, have an influence on the audio signal 1. These influences may assume the form that both the fundamental frequency as well as the frequencies of the higher harmonics of the signal vary. The lower the bit rate of the voice codecs used, the greater the frequency shifts and thus the signal distortions.

Such influences are easiest to examine in connection with vocals. For this reason, the de-noised voice signal 11 is initially fed to a vocal detector 12. This module comprises, for example, a neuronal network that is taught beforehand for the purpose of detecting specific (individual or all) vocals. Vocal signals 13, i.e. signal components that the neuronal network defines as vocals are routed to an evaluation module 14, other signal components are rejected.

The evaluation module 14 divides the vocal signal 13 into signal segments of approx. 30 ms and then calculates a DFT (discrete Fourier transformation) with a frequency resolution of approx. 2 Hz at a sampling frequency of about 8 kHz. In this way it is then possible to determine the fundamental frequency as well as the frequencies of the higher harmonics and to examine them for variations. A further feature for evaluating the codec-related distortions comprises the dynamics of the signal spectrum where lower dynamics signifies poorer signal quality. The reference values for dynamic evaluation are derived from example signals for the individual vocals. A codec quality value 15 is derived from the information relating to the influence of codecs on the frequency shifts and the spectrum dynamics of the audio signal 1 and/or of the de-noised voice signal 11.

Initially, when determining the measure of quality 2 by means of the evaluator module 16, an interruption quality value 17 is taken into consideration in addition to the intrusive quality value 10 and the codec quality value 15. This value contains information on the length and number of interruptions determined by the interruption detection and interpolation module 8. However, in a preferred version example of the invention, only information relating to the long interruptions is considered. In addition, further information 18 relating to the received audio signal 1 or the de-noised voice signal 11, determined with other modules or checks, can, of course, be included in the calculations of the measure of quality 2.

The individual quality values are now scaled in such a way that they are within the numerical range between 0 and 1 where a quality value of 1 signifies undiminished quality and values below 1 correspondingly diminished quality. The measure of quality 2 is finally calculated as a linear combination of the individual quality values where the individual weighting coefficients are determined experimentally and defined in such a way that their sum equals 1.

If further quality-relevant information relating to the telecommunications network is available or if new effects occur in the transmission channels, it is very easily possible to add further modules for calculating further quality values and to take them into consideration in the described manner for the purpose of determining the measure of quality 2.

In the following, several of the modules are described in more detail based on FIGS. 2 to 5. FIG. 2 shows the noise suppression module 7. Initially, the voice signal component 4 of the audio signal 1 is subject to DWT 19 (discrete wavelet transformation). DWTs are used similarly to DFTs for signal analysis purposes. An essential difference however is, in contrast to the temporally unlimited and therefore temporally non-localized sine and/or cosine wave forms used in conjunction with a DFT, the use of so-called wavelets, i.e. temporally limited and therefore temporally localized wave forms with mean value 0.

The voice signal component 4 is divided into signal segments of approx. 20 ms to 30 ms that are then subject to DWT 19. The result of the DWT 19 is a set of DWT coefficients 20.1 that are fed as the input vector to a neuronal network 20. The coefficients of this network were taught beforehand such that as a response to a given set of DWT coefficients 20.1 of a noise-laden signal they provide a new set of new DWT coefficients 20.2 of the noise-free version of this signal. This new set of DWT coefficients 20.2 is now subject to IDWT 21, i.e. inverse DWT with respect to DWT 19. In this way, this IDWT 21 provides a clear version of the voice signal components 4, i.e. the required, de-noised voice signal 11.

The teach-in configuration of the neuronal network 20 is shown in FIG. 3. It is taught with pairs of clear and noise-free versions of example signals. A noise-free example signal 22.1 is subject to DWT 19 and a first set 20.3 of DWT coefficients is obtained. The noise-laden example signal 22.2 is also subject to the same DWT 19 and a second set 20.4 of DWT coefficients is generated that is then fed to the neuronal network 20. The output vector of the neuronal network 20, i.e. the new DWT coefficients 20.5, is compared in a comparator 23 with the first set 20.3 of DWT coefficients. The coefficients of the neuronal network 20 are corrected 24 based on the differences between these two sets of DWT coefficients. This procedure is repeated with a large number of example signal pairs so that the coefficients of the neuronal network 20 execute the required function more and more precisely. Advantageously, example signals 22.1, 22.2 which represent human sounds from various languages are used for the purpose of training the neuronal network 20. It is also of advantage for this purpose to use both women's as well as men's and children's voices. The size of the individual signal segments to be processed of 20 ms to 30 ms duration is selected such that processing of the voice signal component 4 can be carried out irrespective of the language and of the speaker. Speech pauses and very quiet signal sections are also taught to ensure that they are also detected correctly.

In this version example, a multi-layer Perceptron with an input layer 25, a concealed layer 26 and an output layer 27 is used as the neuronal network 20. The Perceptron was taught with a back-propagation algorithm. The input layer 25 features a number of input neurons 25.1, the concealed layer 26 a number of concealed neurons 26.1 and the output layer 2 a number of output neurons 27.1. One of the DWT coefficients 20.1 of the previous DWT 19 is routed to each input neuron 25.1. Once the input signals have passed through the neuronal network, where the respective values are determined with the set coefficients of the respective neurons and the value combinations in the individual neurons are calculated, each output neuron 27.1 supplies one of the new DWT coefficients 20.2. As already mentioned, the audio discriminator 3 breaks down the signal sections into individual buffers of 20 ms length. At a sampling rate of 8 kHz, this corresponds to 160 sampling values. Therefore, a neuronal network 20 with 160 input and output neurons 25.1, 27.1 as well as about 50 to 60 concealed neurons 26.1 can be used for this case.

Based on FIG. 5, the interpolation of a signal interruption is briefly described in the following. Time-frequency interpolation is used, for example, for the signal reconstruction. For this purpose, a short-time spectrum is initially calculated for signal frames with a length of 64 samples (8 ms). This is realized by multiplying the signal frames by Hamming windows at an overlap of 50%.

The aim of interpolation is to process this gap. Frequency-time transformation is executed first. This leads to three-dimensional signal representation that provides the output spectrum in the direction of the z-axis for each point on the time-frequency plane (z-y plane). An interruption at a given point in time t is easy to detect as zero points along the line x=t in the time-frequency plane.

FIG. 5 shows such a signal 28 with a length of approx. 200 samples. FIG. 5 shows the signal 28 in the temporal domain in order to easily identify the periodic configuration. The number of samples is entered on the abscissa 32 and the magnitudes on the ordinate axis 33. Interpolation, however, takes place in the frequency-time domain. In FIG. 5, interruption 29 can be easily detected as a gap with a length just short of 10 samples.

Polynomial interpolation is now executed for each frequency component, i.e. both for the phase as well as the magnitude, with minimum phase and magnitude discontinuity. Initially, the pitch period 30 of the signal 28 is determined for this purpose. Information from the samples before and after the gap within this pitch period 30 is taken into consideration for the interpolation. The signal ranges 31.1, 31.2 show the ranges of the signal 28, a pitch period before and behind the interruption 29. Although these signal ranges 31.1, 31.2 are not identical with the original signal segment at interruption 29, nevertheless, they do show a high degree of similarity to it. For small gaps of up to approx. 10 samples it is assumed that there is still sufficient signal information available in order to be able to execute correct interpolation. Additional information from ambient samples can be used for longer gaps.

Summarizing, it can be determined that the invention makes it possible to assess the signal quality of a received audio signal without having knowledge of the original transmitted signal. From the signal quality it is, of course, also possible to conclude the quality of the used transmission channels and thus the service quality of the entire telecommunications network. The fast response times of the inventive procedure, which are somewhere in the order of 100 ms to 500 ms, therefore enable various applications such as, for example, general comparisons of the service quality of different networks or part networks, quality-based cost billing/accounting or quality-based routing in a network or over several networks by means of corresponding control of the network nodes (gateways, routers etc.).

List of Reference Numbers

| | |
|---|---|
| 1 | Audio signal |
| 2 | Measure of quality |
| 3 | Audio discriminator |
| 4 | Voice signal component |
| 5.1 | Music |
| 5.2 | Pauses |
| 5.3 | Strong signal interference |
| 6 | Reference signal |
| 7 | Noise suppression module |
| 8 | Interruption detection and interpolation module |
| 9 | Comparator module |
| 10 | Intrusive quality value |
| 11 | De-noised voice signal |
| 12 | Vocal detector |
| 13 | Vocal signal |
| 14 | Evaluation module |
| 15 | Codec quality value |
| 16 | Evaluator module |
| 17 | Interruption quality value |
| 18 | Quality information |
| 19 | DWT |
| 20 | Neuronal network |

-continued

| | |
|---|---|
| 20.1, 20.2, 20.3, 20.4, 20.5 | DWT coefficients |
| 21 | IDWT |
| 22.1, 22.2 | Example signal |
| 23 | Comparator |
| 24 | Correction |
| 25 | Input layer |
| 25.1 | Input neuron |
| 26 | Concealed layer |
| 26.1 | Concealed neuron |
| 27 | Output layer |
| 27.1 | Output neuron |
| 28 | Signal |
| 29 | Interrupt |
| 30 | Pitch period |
| 31.1, 31.2 | Signal range |
| 32 | Abscissa |
| 33 | Ordinate axis |

What is claimed is:

1. A method of determining quality of an audio signal, comprising:

discriminating voice signal components from the audio signal;

deriving a reference signal from the voice signal components of the audio signal, first by removing or suppressing noise from the voice signal components and second by detecting and interpolating interruptions in the audio signal or the voice signal components, wherein the reference signal approximates an original source signal of the audio signal; and determining a level of similarity between the voice signal components and the reference signal by comparing the voice signal components with the reference signal, wherein higher levels of similarity indicate greater quality of the audio signal.

2. The method according to claim 1, further including:

subjecting the voice signal components of the audio signal to discrete wavelet transformation (DWT) to generate a set of DWT coefficients;

providing the set of DWT coefficients to a pre-trained neural network to generate a noise-free set of DWT coefficients; and subjecting the noise-free set of DWT coefficients to an inverse discrete wavelet transformation (IDWT) to generate a de-noised signal.

3. The method according to claim 1, further including:

providing a de-noised version of the voice signal components to a pre-trained neural network to extract vocal signals from the de-noised version of the voice signal components; and deriving a codec quality value based on information relating to influence of codecs on frequency shifts and spectrum degradations extracted from the de-noised version of the voice signal components.

4. The method according to claim 1, wherein interpolating the interruptions is based on a length of the interruptions such that polynomial interpolation is utilized for short interruptions and model-based interpolation is utilized for medium-to-long interruptions to derive the reference signal.

5. The method according to claim 4, wherein an interruption quality value containing information regarding length and number of interruptions detected is utilized to determine the level of similarity between the voice signal components and the reference signal.

6. An apparatus to determine quality of an audio signal, comprising:

an audio discriminator to receive the audio signal and to discriminate voice signal components from the audio signal;

a reference signal generator to receive the voice signal components from the audio discriminator and to derive a reference signal from the voice signal components of the audio signal, first by a noise suppression module removing or suppressing noise from the voice signal components and second by a interruption detection and determination module detecting and interpolating interruptions in the audio signal or the voice signal components, wherein the reference signal approximates an original source signal of the audio signal; and a comparator to determine a level of similarity between the voice signal components and the reference signal by comparing the voice signal components with the reference signal, wherein higher levels of similarity indicate greater quality of the audio signal.

7. The apparatus according to claim 6, wherein interruption detection and interpolation module utilizes polynomial interpolation for short interruptions, and model-based interpolation for medium-to-long interruptions to derive the reference signal.

8. The apparatus according to claim 6, further including:

a vocal detection module to receive a de-noised signal version of the voice signal components from the reference signal generator and including a pre-trained neural network to extract vocal signals from the received de-noised version of the voice signal components; and an evaluation module to receive the vocal signals, and to derive a codec quality value from information relating to influence of codes on frequency shifts and the vocal signals received.

9. The apparatus according to claim 6, wherein the noise suppression module is further adapted to subject the voice signal components of the audio signal to discrete wavelet transformation (DWT) to generate a set of DWT coefficients, to provide the set of DWT coefficients to a pre-trained neural network to generate a noise-free set of DWT coefficients, and to subject the noise-free set of DWT coefficients to an inverse discrete wavelet transformation (IDWT) to generate a de-noised signal.

10. A method of determining quality of an audio signal, comprising:

discriminating voice signal components from the audio signal;

deriving a reference signal from the voice signal components of the audio signal, wherein the reference signal approximates an original source signal of the audio signal; and comparing the voice signal component with the reference signal to determine an intrusive quality value, wherein the voice signal component and the reference signal are broken down into smaller signal segments and a part quality value is calculated for at least some of the signal segments and the intrusive quality value is determined as the arithmetic mean of the part quality values for some of the signal segments.

11. The method of claim 10, further including, calculating of a codec quality value which is derived from information relating to influence of codes on frequency shifts and the spectrum degradations of a de-noised voice signal created during the deriving of the reference signal which is a de-noised version of the voice signal components; and determining an interruption quality value based on length and number of interruptions detected in the de-noised voice signal, and determining a measure of quality of the audio signal by considering the intrusive quality value, the codec quality value, and the interruption quality value.

12. The method of claim 10, further including sorting out music, pauses, and strong signal interference from the audio signal along with discriminating voice signal components from the audio signal.

13. An apparatus to determine quality of an audio signal, comprising:

an audio discriminator to receive the audio signal and to discriminate voice signal components from the audio signal;

a reference signal generator to receive the voice signal components from the audio discriminator and to derive a reference signal from the voice signal components of the audio signal, wherein the reference signal approximates an original source signal of the audio signal; and a comparator to compare the voice signal component with the reference signal to determine an intrusive quality value, wherein the voice signal component and the reference signal are broken down into smaller signal segments and a part quality value is calculated for at least some of the signal segments and the intrusive quality value is determined as the arithmetic mean of the part quality values for the at least some of the signal segments.

14. The apparatus of claim 13, further including, an evaluation module to calculate a codec quality value based on information relating to influence of codecs on frequency shifts and the spectrum degradations of a de-noised voice signal created by a noise suppression module in the reference signal generator, an interruption detection and interpolation module to determine an interruption quality value based on length and number of interruptions detected in the de-noised voice signal, and a evaluator module to determine a measure of quality of the audio signal by considering the intrusive quality value, the codec quality value, and the interruption quality value.

15. The apparatus of claim 13, wherein the audio discriminator further sorts out music, pauses, and strong signal interference from the audio signal along with discriminating voice signal components from the audio signal.

* * * * *